US010215356B2

(12) United States Patent
Lee

(10) Patent No.: US 10,215,356 B2
(45) Date of Patent: Feb. 26, 2019

(54) LIGHTING UNIT FOR VEHICLE

(71) Applicant: LG Innotek Co., Ltd., Seoul (KR)

(72) Inventor: Jung Ho Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 7 days.

(21) Appl. No.: 15/125,824

(22) PCT Filed: Mar. 13, 2015

(86) PCT No.: PCT/KR2015/002449

§ 371 (c)(1),
(2) Date: Sep. 13, 2016

(87) PCT Pub. No.: WO2015/137765

PCT Pub. Date: Sep. 17, 2015

(65) Prior Publication Data

US 2017/0002992 A1 Jan. 5, 2017

(30) Foreign Application Priority Data

Mar. 13, 2014 (KR) ..... 10-2014-0029355

(51) Int. Cl.
*F21S 43/31* (2018.01)
*F21S 41/33* (2018.01)
(Continued)

(52) U.S. Cl.
CPC ..... *F21S 41/338* (2018.01); *F21S 43/14* (2018.01); *F21S 43/31* (2018.01); *F21S 43/33* (2018.01); *F21S 45/47* (2018.01)

(58) Field of Classification Search
USPC ..... 362/509
See application file for complete search history.

(56) References Cited

U.S. PATENT DOCUMENTS 6,053,623 A * 4/2000 Jones ..... F21S 48/1394 362/158
2006/0262551 A1 11/2006 Fallahi et al.
(Continued)

FOREIGN PATENT DOCUMENTS

CN 1189589 A 8/1998
CN 1587789 A 3/2005
(Continued)

OTHER PUBLICATIONS

International Search Report in International Application No. PCT/KR2015/002449, filed Mar. 13, 2015.
(Continued)

*Primary Examiner* — Rafferty D Kelly
(74) *Attorney, Agent, or Firm* — Saliwanchik, Lloyd & Eisenschenk

(57) ABSTRACT

Examples of the present invention relate to a lighting unit having an unconstrained curvature, irrespective of the shape of an installation space, and implementing high light-emitting efficiency with a small number of light sources, the lighting unit comprising: a reflection module including a pair of first side portions and a bottom portion connected thereto; and a light-emitting module for emitting light into the reflection module, wherein the bottom portion includes a curved region including at least one inflection point.

18 Claims, 2 Drawing Sheets

(51) Int. Cl.

| | |
|---|---|
| ***F21S 43/14*** | (2018.01) |
| ***F21S 43/33*** | (2018.01) |
| *F21S 45/47* | (2018.01) |

(56) References Cited

U.S. PATENT DOCUMENTS

| | | | | |
|---|---|---|---|---|
| 2007/0127252 | A1 | 6/2007 | Fallahi et al. | |
| 2010/0301376 | A1 | 12/2010 | Kim et al. | |
| 2013/0294101 | A1 | 11/2013 | Brendle | |
| 2014/0056008 | A1* | 2/2014 | Rice | F21S 48/215 362/346 |

FOREIGN PATENT DOCUMENTS

| | | | |
|---|---|---|---|
| CN | 102679201 | A | 9/2012 |
| CN | 103375747 | A | 10/2013 |
| DE | 102010054923 | A1 | 6/2012 |
| GB | 2495637 | A | 4/2013 |
| JP | H10233105 | A | 9/1998 |
| JP | 2003031007 | A | 1/2003 |
| JP | 2011134548 | A | 7/2011 |
| WO | WO-2008/002068 | A1 | 1/2008 |

OTHER PUBLICATIONS

Extended European Search Report dated Sep. 2, 2017 in European Application No. 15761270.6.
Chinese Office Action dated Dec. 25, 2017 in Chinese Application No. 201580013924.8, along with its English translation.

* cited by examiner

【Fig. 1】
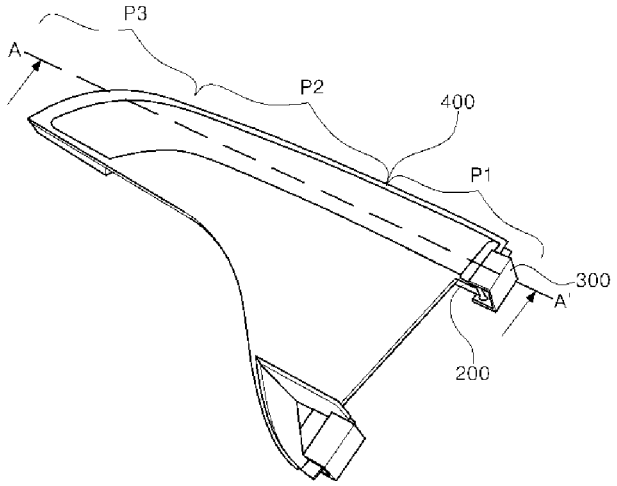
【Fig. 2】
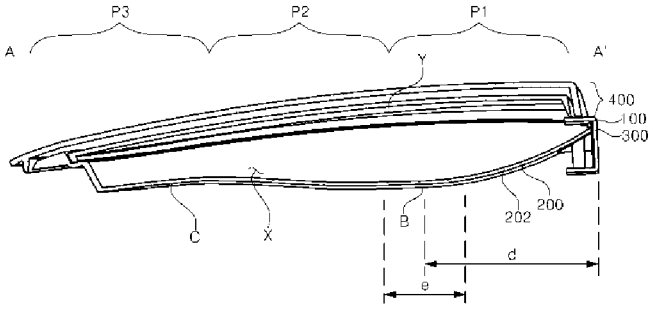

【Fig. 3】
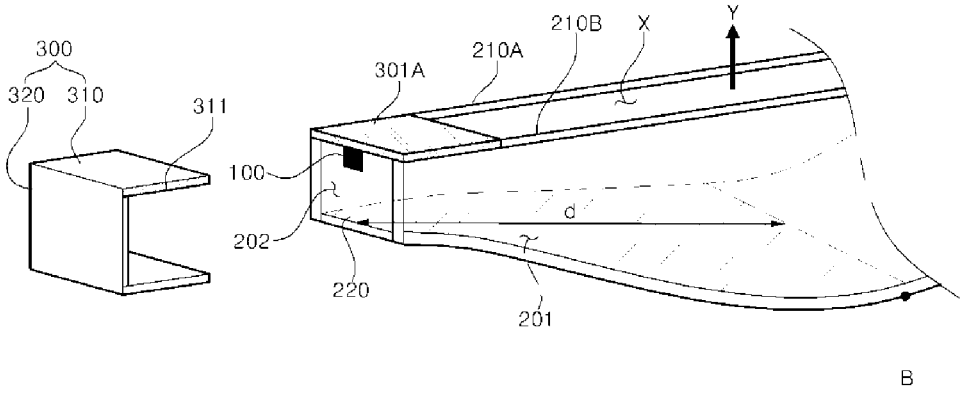
【Fig. 4】
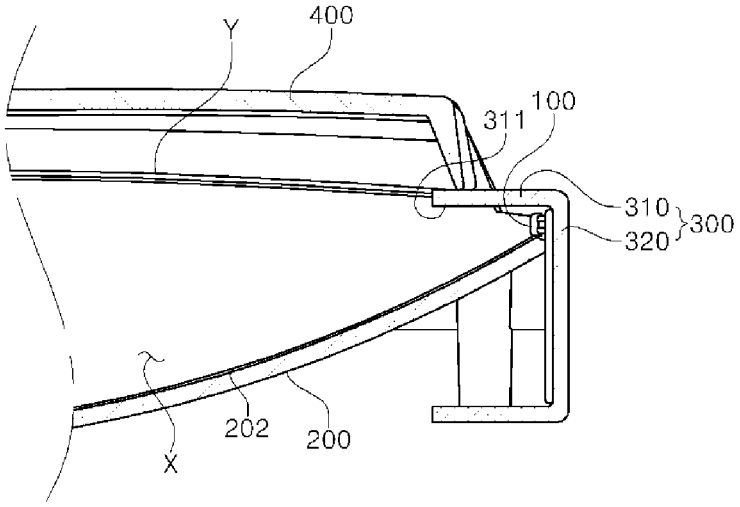

LIGHTING UNIT FOR VEHICLE

CROSS-REFERENCE TO RELATED APPLICATIONS

This application is the U.S. national stage application of International Patent Application No. PCT/KR2015/002449, filed Mar. 13, 2015, which claims priority to Korean Application No. 10-2014-0029355, filed Mar. 13, 2014, the disclosures of each of which are incorporated herein by reference in their entirety.

TECHNICAL FIELD

Embodiments relate to a lighting unit, which is capable of being freely curved irrespective of the shape of an installation space and realizes high light-emitting efficiency with a small number of light-emitting elements.

BACKGROUND ART

Lighting units for use in electronic appliances are configured to adopt suitable light sources depending on the characteristics of electronic appliances in order to increase light-emitting efficiency.

Recent lighting units used in electronic appliance may be applied in various ways, for example, to a backlight unit of a flat panel display, an indoor lamp used in an indoor environment, a headlight, a fog light, a backup light, a sidelight, a license plate light, a taillight, a brake light, a turn signal, or a hazard flasher lamp installed on the exterior of a vehicle, or a passenger compartment light installed inside a vehicle.

However, most of these lighting units have adopted a member for increasing the efficiency of transmission of light, such as a light guide plate, in the interest of maximizing the luminance of a surface light source.

In particular, lighting units for vehicles have recently been developed to adopt, as a light source, light-emitting diodes (LEDs), which realize high light-emitting efficiency. In the case of lighting units for vehicles using a surface light source, the use of an LED package as a light source is on the rise. However, when such a LED package is used as a light source, an increase in the number of light-emitting elements constituting a light-emitting surface is necessary in order to achieve a great quantity of light or to realize surface light-emission. The use of a great number of LED packages is problematic in terms of cost and heat radiation as well as in the realization of a circuit between elements due to, for example, curved places or narrow spaces in vehicles, which cause serious disadvantages of high cost and low efficiency. In addition, in the case of a taillight or a location on the vehicle from which light is emitted and which has a curved surface, it is difficult to realize uniform intensity of light over such a light-emitting surface, leading to dark spaces before and after a curved portion. When additional light-emitting elements are used to overcome this problem, an increase in costs is necessarily incurred.

DISCLOSURE

Technical Problem

Embodiments are provided to solve the problems described above, and more particularly, may provide a lighting unit for a vehicle, which includes a reflection module having a curved reflector to realize surface light-emission without a light guide plate, thereby achieving high light-emitting efficiency with a small number of light-emitting elements.

In addition, uniform light-emission from a desired light-emitting surface may be accomplished via a light movement path, which is formed using only an air layer provided in the reflection module. Because a light-emitting module, which is mounted in any of various exterior locations of a vehicle, may have various bent portions and may be mounted in a narrow space, the lighting unit may be installed in a narrow area while maintaining high light-emitting efficiency thereof, and may thus enable increased freedom of design.

Technical Solution

To achieve the object described above, an embodiment provides a lighting unit for a vehicle including a reflection module having a pair of first side portions and a bottom portion connected thereto, and a light-emitting module for emitting light to an inside of the reflection module, wherein the bottom portion includes a curved region having at least one inflection point.

Advantageous Effects

According to an embodiment, a reflection module having a curved reflector for a vehicle is used to realize surface lighting without a light guide plate, which has the effect of achieving high light-emitting efficiency with a small number of light-emitting elements.

In addition, a light-emitting module, which is mounted in any of various exterior locations of a vehicle, may have various bent portions and may be mounted in a narrow space, which has the effects of enabling the lighting unit to be installed in a narrow area while maintaining high light-emitting efficiency thereof and increasing freedom of design.

DESCRIPTION OF DRAWINGS

FIG. 1 is a perspective view of a lighting unit for a vehicle according to an embodiment.

FIG. 2 is a sectional view taken along line A-A' of FIG. 1.

FIG. 3 is a conceptual view for explaining the structures of a reflection module and a light-emitting module according to an embodiment.

FIG. 4 is an enlarged view of the important part of FIG. 2.

DESCRIPTION OF REFERENCE NUMERALS

100: light-emitting module
200: reflection module
210A, 210B: first side portion
220: bottom portion
230: second side portion
300: second reflection module
400: optical member

BEST MODE

Hereinafter, configurations and operations according to embodiments will be described in detail with reference to the accompanying drawings. In the description with reference to the accompanying drawings, the same elements are designated by the same reference numerals, and a repeated description thereof is omitted. Although the terms "first", "second" etc. may be used to describe various components, these components should not be limited by the terms. The terms are used only to distinguish one component from other components.

FIG. 1 is a perspective view of a lighting unit for a vehicle according to an embodiment, FIG. 2 is a sectional view taken along line A-A' of FIG. 1, FIG. 3 is a conceptual view for explaining the structures of a reflection module and a light-emitting module according to an embodiment, and FIG. 4 is an enlarged view of the important part of FIG. 2.

Referring to FIGS. 1 to 4, the lighting unit for the vehicle according to the embodiment may include a reflection module 200 having a pair of first side portions and a bottom portion connected thereto, and a light-emitting module 100 for emitting light to the inside of the reflection module 200. In particular, the reflection module 200 may be implemented so that the bottom portion, which is a bottom surface, includes a curved region having at least one inflection point. In particular, the first side portions may be provided so as to extend upward from opposite sides of the bottom portion, and may be spaced apart from each other. The space between the first side portions may function as a movement path, along which emitted light moves, and the top of the space may be implemented as a light-emitting surface for surface light-emission.

That is, the lighting unit for the vehicle according to the embodiment has a feature such that light emitted from the light-emitting module 100, which is mounted on an edge portion corresponding to a distal end portion of the reflection module 200 illustrated in FIG. 1, is uniformly transmitted to an opposite distal end portion along the light movement path formed using only an air layer inside the reflection module 200, which is implemented so as to obviate a light guide plate, thereby being uniformly emitted upward.

Many vehicle lights are configured so that a surface light-emitting region is bent as illustrated in FIG. 1. In this case, the intensity of light is strong in a region PI close to the light-emitting module, whereas a dark space is generated in a bent region P3 because light is lost or is not transmitted, which is problematic. In addition, a local dark place may be generated even in the region PI depending on the light-emitting direction of a light-emitting element at a position close to the light-emitting element. To solve this problem, in the embodiment, the bottom portion of the reflection module 200 is curved as illustrated in FIG. 2.

Specifically, referring to FIG. 2, the light-emitting module 100 functions to emit light to the inside of the reflection module 200. Of course, the inside of the reflection module 200 is empty and defines an air layer so as to form a light movement path X of the emitted light. That is, the light passes through the inside of the reflection module without using a separate light guide plate and is transmitted to the distal end of the reflection module, and in this process, the top side may serve as a light-emitting surface Y for realizing uniform surface light-emission.

The light-emitting module 100 may basically include a printed circuit board (PCB) on which a light-emitting element is mounted. In this case, the PCB may mean a board provided with a circuit pattern thereon, and may be selected from among an opaque PCB, a transparent PCB, and a flexible PCB. For example, an FR4 PCB may be used to achieve firm support force, or a flexible PET PCB may be used to ensure efficient positioning of a bent surface. In an embodiment, a flexible PCB (FPCB) may be used in order to achieve a certain degree of flexibility. That is, the PCB according to the embodiment may be any one of a metal core PCB, an FR4 PCB, and a general PCB, without being limited thereto.

One or more light-emitting elements, which constitute the light-emitting module 100, may be mounted on the PCB and may serve to emit light, and may conceptually include various light-emitting elements, such as, for example, solid light-emitting elements. Such solid light-emitting elements may be any one selected from among LEDs, organic LEDs (OLEDs), laser diodes (LDs), laser, and vertical cavity surface emitting laser (VCSEL).

In the embodiment, each of the light-emitting elements will be described as an LED by way of example. Such an LED may be implemented as a colored LED chip, such as a red LED chip for generating red light, a blue LED chip for generating blue light, or a green LED chip for generating green light, or may be implemented as a UV LED chip. In addition, one or more LED chips may be mounted on the PCB, and the embodiment is not limited as to the kind or the number of LED chips. In addition, a protective element (e.g. a Zener diode) may be mounted so as to protect the light-emitting element.

In this case, the light-emitting element may include a side-view-type LED. That is, an LED, which is configured to emit light laterally, rather than upward, may be used as the light-emitting element of the embodiment. This is advantageous in increasing the efficiency of transmission of light to the reflection module 200 and in reducing light loss.

The structures and operations of the above-described light-emitting module and reflection module according to the embodiment will be described in more detail with reference to FIGS. 2 to 4.

Referring to FIGS. 2 and 3, the reflection module according to the embodiment, as illustrated in FIG. 3, may be formed as a structure that defines the light movement path X therein, has a given width and height, and is open at the top side thereof. The light movement path X may be implemented as a channel defined in a structure including a pair of first side portions 210A and 210B and a bottom portion 220 connected thereto as illustrated in FIG. 3.

As described above, the light-emitting module 100 emits light to the light movement path X of the reflection module 200, and the emitted light collides with and is reflected by the inner surfaces of the first side portions 210A and 210B and the bottom portion 220, thereby moving in the longitudinal direction of the reflection module. In this case, the light-emitting module 100 may be located on a second side portion, which is an edge portion in the longitudinal direction of the reflection module.

Accordingly, the light-emitting module 100 of the embodiment may be located on the outer distal end portion of the reflection module 200, and may realize uniform light-emission over the entire light-emitting surface attributable to the controlled transmission of light by the reflection function of the reflection module. Accordingly, it is unnecessary to provide a plurality of LED packages vertically below the light-emitting surface Y in order to realize surface light-emission over the entire area of the light-emitting surface Y, and it is unnecessary to adopt a light guide plate for the transmission of light. Therefore, uniform surface light-emission may be advantageously realized using only a very small number of light-emitting elements.

To this end, the inner surface of the reflection module 200 may be formed of a reflective material, or may be formed of a general synthetic resin or metal material and then coated with a reflective material.

In particular, in the reflection module 200 according to another embodiment, in order to increase reflection efficiency, the first side portions 210A and 210B and the bottom portion 220 connected thereto may include a first reflective layer 201 formed on the inner surfaces thereof. Of course, the first side portions 210A and 210B and the bottom portion 220 may be formed of a reflective material without forming a separate reflective layer. In one example, the first side portions 210A and 210B and the bottom portion 220 may be formed of a material including any one of Al, PC, PP, ABS, and PBT.

The first reflective layer may be formed by, for example, depositing Al or attaching an Al sheet on the inner surface of the reflection module 200, which is formed of a synthetic resin or a metal material. This may be equally applied to a second reflective layer and a third reflective layer, which will be described later.

The first to third reflective layers may be implemented so as to increase reflectance by using a resin material including a reflective member or a structure having a surface coated with a reflective material. The reflective layers may be formed of, for example, a resin material, a metal material, or a non-metal material. In this case, the reflective member or the reflective material may be formed of at least one selected from among silver (Ag), aluminum (Al), platinum (Pt), chrome (Cr), nickel (Ni), titanium oxide, silicon oxide, aluminum oxide, magnesium fluoride, tantalum oxide, and zinc oxide.

The constituent material of the reflective layers is of course not limited thereto, and the reflective layers may be formed into a deposited thin-film form or a reflective pattern form, rather than being formed into a sheet or film form. In order to realize characteristics for facilitating the reflection and distribution of light, a synthetic resin containing a white pigment distributed therein may be applied. The white pigment may be selected from among titanium oxide, aluminum oxide, zinc oxide, carbonate, barium sulfate, calcium carbonate, etc., and the synthetic resin may be selected from among polyethylene terephthalate, polyethylene naphthalate, acrylic resin, polycarbonate, polystyrene, polyolefin, cellulose acetate, and weatherproof vinyl chloride. Alternatively, the inner surface of the reflection module may be patterned using a reflective ink including any one of $TiO_2$, $CaCO_3$, $BaSO_4$, $Al_2O_3$, silicon, and PS, or the surface of the reflective layer, which is formed in a sheet or coating form as described above, may be patterned in order to increase reflection efficiency.

In addition, the reflection module 200 according to the embodiment may be configured such that the bottom portion 220 thereof has a curved structure having one or more inflection points B and C.

Referring to FIGS. 2 and 3, when the light-emitting module emits light, a great quantity of light is directed to the center of the reflection module 200, causing a local dark space to be generated in the space between the first inflection point B and the light-emitting module 100. In addition, it is difficult to achieve the reflectance required to uniformly transmit light to the distal end of the reflection module 200. Accordingly, the bottom portion, having a curved structure, may increase the proportion of light that is reflected, which may increase the quantity of light. To this end, a reflective layer (hereinafter referred to as a second reflective layer 202) may be disposed on the surface of the bottom portion 220 between the first inflection point B and the light-emitting module 100.

Although the second reflective layer 202 may be formed over the entire inner surface of the bottom portion, in order to achieve high efficiency at low cost and to achieve a uniform light characteristic, in the embodiment, the second reflective layer 202 may be formed to a length that is equal to or less than the distance from the light-emitting module 100 to the second inflection point among the first inflection point B and the second inflection point C, which are arranged in sequence from the light-emitting module 100. In particular, the second reflective layer 202 may be formed to a length of 0.9 to 1.1 times the distance d from the light-emitting module 100 to the first inflection point, and the distal end point of the second reflective layer 202 may reach a region e in the vicinity of the inflection point as illustrated in FIG. 2. This is because a local dark space is generated the most frequently in the range of 0.9 to 1.1 times the distance d from the light-emitting module 100 to the first inflection point. When the length of the second reflective layer 202 exceeds this range, the increase in light-emitting efficiency is not great compared to the cost.

A second reflection module 300 among detailed configurations according to the embodiment will be described below with reference to FIGS. 2 to 4.

As described above, the light-emitting module 100, which emits light to the inside of the reflection module 200, is located on the distal end portion of the reflection module 200. In this case, the light emitted from the light-emitting module 100 is directed to the inside of the reflection module 200. Because the width of the emitted light is considerably increased immediately after the light is emitted, strong light is emitted upward, which deteriorates the uniformity of light and causes light loss.

To solve this problem, in the embodiment, in order to increase the quantity of light that is directed to the inside of the reflection module 200 by controlling the upward emission of light, the second reflection module 300 may be additionally provided above the light-emitting module. The second reflection module 300 may be configured to cover the upper surface of the light-emitting module 100, and may have any of various shapes so long as it can reflect the emitted light so as to cause the light to be directed to the inside of the reflection module 200.

In one example of implementation of the second reflection module 300, as illustrated in FIG. 4, the second reflection module 300 may include a reflector 310 disposed above the light-emitting module for reflecting light to the inside of the reflection module 200, and a radiator 320 extending from the reflector 310 so as to be close to or to come into contact with the rear surface of the light-emitting module 100. In this case, as illustrated in FIG. 4, the radiator 320 may be configured so as to come into contact with the second side portion and the bottom portion. In particular, the radiator 320 may be configured to cover an open region of the second side portion.

The reflector 310 and the radiator 320 may be integrally formed with each other, and may be formed of the same material, which may increase heat radiation efficiency and reflectance. The radiator 320 functions to dissipate heat generated from the light-emitting elements, such as LEDs, to the outside. In this case, the inner surface of the reflector 310 may be provided with a third reflective layer 311 formed via, for example, deposition or coating.

As illustrated in FIG. 4, the reflection module 300, in which the reflector 310 and the radiator 320 are integrally formed with each other, also functions to stably fix and support the reflection module and the light-emitting module, in addition to the function of increasing light reflectance and heat radiation, thereby further increasing the stability of equipment.

In addition, in the case of the lighting unit according to the present embodiment, as illustrated in FIGS. 2 to 4, an optical member 400 including a plurality of lens members or diffusive members may be provided above the light-emitting surface Y.

Although the exemplary embodiments have been illustrated and described as above, it will of course be apparent to those skilled in the art that the embodiments are provided to assist understanding and the embodiments are not limited to the above description, and various modifications and variations can be made in the embodiments without departing from the spirit or scope of the disclosure, and the modifications and variations should not be understood individually from the viewpoint or scope of the disclosure so long as they include the constituent elements set forth in the claims.

INDUSTRIAL APPLICABILITY

A lighting unit for a vehicle according to the embodiment described above may be applied to a taillight, a stop light, and a turn signal. That is, the lighting unit may be applied to various lamp devices required for illumination, for example, vehicle lamps, home lighting apparatuses, and industrial lighting apparatuses. For example, when applied to vehicle lamps, the lighting unit may be applied as a headlight, a passenger compartment light, an LED moving door scarf light, and a rear light. In addition, the lighting unit may be applied to a backlight used in a liquid crystal display device, and may also be applied to all lighting fields, which have currently been developed or commercialized, or may be implemented via future technical developments.

The invention claimed is:

1. A lighting unit for a vehicle comprising:

a reflection module including a bottom portion and a first side portion extending upward from one side of the bottom portion; and a light-emitting module for emitting light to an inside of the reflection module, wherein the bottom portion includes a first region, a second region having a first inflection point, and a third region having a second inflection point, wherein the first region, the second region, and the third region are disposed in a sequence from the light-emitting module to an end portion of the bottom portion, wherein surfaces of the first region, the second region, and the third region are curved, wherein the first side portion and the bottom portion are formed of a reflective material, wherein the reflection module further includes a second reflective layer disposed on the second region of the bottom portion, wherein the first region and the third region of the bottom portion are exposed, wherein a center of a curvature of the bottom portion is disposed above the first inflection point at a region adjacent to the first inflection point, and wherein a center of the curvature of the bottom portion is disposed below the second inflection point at a region adjacent to the second inflection point.

2. The lighting unit according to claim 1, wherein the light-emitting module is located close to a second side portion provided on an outer distal end of the first side portion of the reflection module.

3. The lighting unit according to claim 2, wherein the light-emitting module includes a solid light-emitting element mounted on a printed circuit board.

4. The lighting unit according to claim 3, wherein the solid light-emitting element is a side-view-type light-emitting diode (LED).

5. The lighting unit according to claim 1, wherein the reflection module further includes a first reflective layer disposed on an inner surface of the first side portion.

6. The lighting unit according to claim 5, wherein the reflection module and the first reflective layer are integrally formed with each other.

7. The lighting unit according to claim 1, wherein the reflection module is formed of any one material selected from among Al, PC, PP, ABS, and PBT.

8. The lighting unit according to claim 1, wherein the second reflective layer is formed with a length that is 0.9 to 1.1 times of a distance from the arrangement position of the light-emitting module to the first inflection point.

9. The lighting unit according to claim 1, further comprising a second reflection module including a reflector disposed above the light-emitting module.

10. The lighting unit according to claim 9, wherein the second reflection module is located to cover a portion of an upper surface of the first side portion.

11. The lighting unit according to claim 10, wherein the second reflection module further includes a radiator extending from an outer distal end of the reflector so as to be close to the light-emitting module.

12. The lighting unit according to claim 11, wherein the radiator is in direct contact with the second side portion and the bottom portion.

13. The lighting unit according to claim 1, further comprising an optical member that includes a plurality of lens members or diffusive members disposed above a light-emitting surface of the light-emitting module, the optical member having a bent portion, and the bent portion directly contacting the light-emitting module.

14. A lighting unit for a vehicle comprising:

a reflection module including a bottom portion and a first side portion extending upward from one side of the bottom portion; and a light-emitting module for emitting light to an inside of the reflection module, wherein the bottom portion includes a first region, a second region having a first inflection point, and a third region having a second inflection point, wherein the first region, the second region, and the third region are disposed in a sequence from the light-emitting module to an end portion of the bottom portion, wherein surfaces of the first region, the second region, and the third region are curved, wherein the reflection module includes a first reflective layer disposed on an inner surface of the first side portion and a second reflective layer disposed on the second region of the bottom portion, wherein the first region and the third region of the bottom portion is are exposed, wherein a center of a curvature of the bottom portion is disposed above the first inflection point at a region adjacent to the first inflection point, and wherein a center of the curvature of the bottom portion is disposed below the second inflection point at a region adjacent to the second inflection point.

15. The lighting unit according to claim 14, wherein the second reflective layer is formed with a length that is 0.9 to 1.1 times of a distance from the arrangement position of the light-emitting module to the first inflection point.

16. The lighting unit according to claim 14, wherein the reflection module further includes a third reflective layer disposed on an inner surface of the reflector.

17. The lighting unit according to claim 14, wherein the first side portion and the bottom portion are formed of a reflective material.

18. The lighting unit according to claim 14, wherein each of the first reflective layer to the third reflective layer is a reflective material layer including at least one selected from among silver (Ag), aluminum (Al), platinum (Pt), chrome (Cr), nickel (Ni), titanium oxide, silicon oxide, aluminum oxide, magnesium fluoride, tantalum oxide, and zinc oxide.

* * * * *